US011905138B2

(12) United States Patent
Suzuki

(10) Patent No.: US 11,905,138 B2
(45) Date of Patent: Feb. 20, 2024

(54) SHEET CONVEYANCE DEVICE AND IMAGE FORMING APPARATUS EQUIPPED WITH SHEET CONVEYANCE DEVICE

(71) Applicant: CANON KABUSHIKI KAISHA, Tokyo (JP)

(72) Inventor: Yuta Suzuki, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 118 days.

(21) Appl. No.: 17/519,144

(22) Filed: Nov. 4, 2021

(65) Prior Publication Data

US 2022/0162025 A1 May 26, 2022

(30) Foreign Application Priority Data

Nov. 25, 2020 (JP) ..... 2020-194811

(51) Int. Cl.

| | |
|---|---|
| ***B65H 5/06*** | (2006.01) |
| ***B65H 29/58*** | (2006.01) |
| ***B65H 9/16*** | (2006.01) |
| ***B65H 9/00*** | (2006.01) |

(52) U.S. Cl.

CPC ..... *B65H 5/062* (2013.01); *B65H 9/006* (2013.01); *B65H 9/166* (2013.01); *B65H 29/58* (2013.01); *B65H 2301/331* (2013.01); *B65H 2404/1441* (2013.01); *B65H 2513/10* (2013.01)

(58) Field of Classification Search

CPC ..... B65H 5/062; B65H 9/004; B65H 9/006; B65H 2301/331; B65H 2404/144; B65H 2404/1441; B65H 2513/10

See application file for complete search history.

(56) References Cited

U.S. PATENT DOCUMENTS

| | | | | |
|---|---|---|---|---|
| 2013/0134663 | A1* | 5/2013 | Deno | B65H 5/062 271/228 |
| 2017/0291782 | A1* | 10/2017 | Sato | B65H 9/004 |
| 2019/0062093 | A1* | 2/2019 | Inoue | B65H 5/062 |
| 2020/0156890 | A1* | 5/2020 | Takane | B65H 5/062 |

FOREIGN PATENT DOCUMENTS

| | | | | |
|---|---|---|---|---|
| JP | H08217291 A | * | 8/1996 | B65H 9/14 |
| JP | 2007-106572 A | | 4/2007 | |

* cited by examiner

*Primary Examiner* — Prasad V Gokhale
(74) *Attorney, Agent, or Firm* — Venable LLP

(57) ABSTRACT

A sheet conveyance device capable of reducing occurrence of creases on a sheet includes first conveyance rollers that nip and convey a sheet, second conveyance rollers arranged downstream that convey the sheet, registration rollers arranged further downstream that nip and convey the sheet after correcting skew of the sheet, a switching portion that switches a state of the second conveyance rollers between contact and separated states, and a control unit that controls the rollers and the switching mechanism. The control unit switches between first and second conveyance operations. In both conveyance operations, the registration rollers start rotating to convey the sheet of which the skew has been corrected by the first conveyance rollers and the registration rollers and the second conveyance rollers are in the separated state. In the first conveyance operation, a sheet conveyance speed by the registration rollers is higher than that by the first conveyance rollers, whereas in the second conveyance operation, the sheet conveyance speed by the registration rollers is lower than that by the first conveyance rollers.

10 Claims, 13 Drawing Sheets

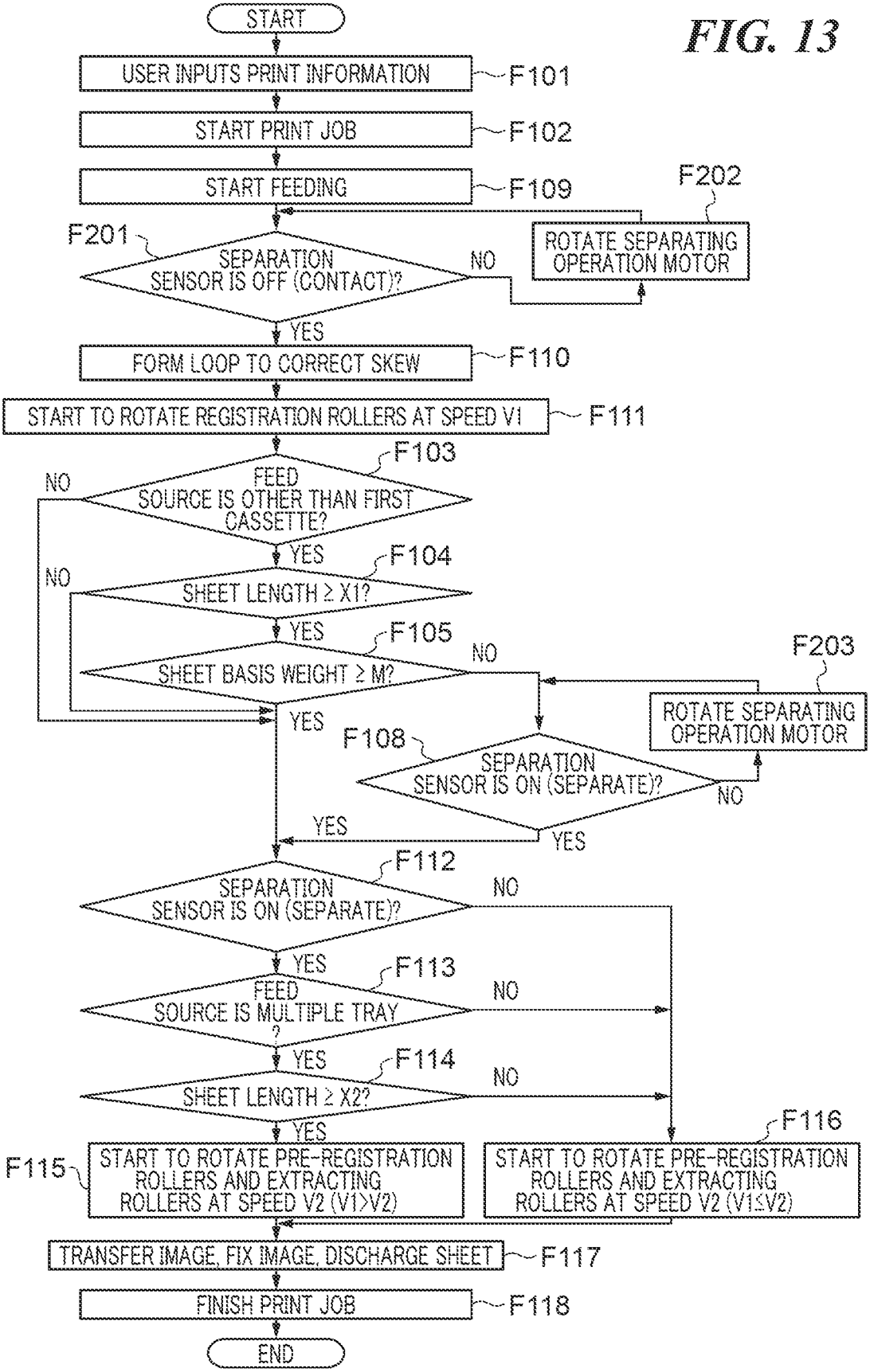
FIG. 13
START
USER INPUTS PRINT INFORMATION
F101
START PRINT JOB
F102
START FEEDING
F109
F202
ROTATE SEPARATING OPERATION MOTOR
F201
SEPARATION SENSOR IS OFF (CONTACT)?
NO
YES
FORM LOOP TO CORRECT SKEW
F110
START TO ROTATE REGISTRATION ROLLERS AT SPEED V1
F111
F103
FEED SOURCE IS OTHER THAN FIRST CASSETTE?
NO
YES
F104
SHEET LENGTH ≥ X1?
NO
YES
F105
SHEET BASIS WEIGHT ≥ M?
NO
YES
F203
ROTATE SEPARATING OPERATION MOTOR
F108
SEPARATION SENSOR IS ON (SEPARATE)?
NO
YES
YES
F112
SEPARATION SENSOR IS ON (SEPARATE)?
NO
YES
F113
FEED SOURCE IS MULTIPLE TRAY ?
NO
YES
F114
SHEET LENGTH ≥ X2?
NO
YES
F115
START TO ROTATE PRE-REGISTRATION ROLLERS AND EXTRACTING ROLLERS AT SPEED V2 (V1>V2)
F116
START TO ROTATE PRE-REGISTRATION ROLLERS AND EXTRACTING ROLLERS AT SPEED V2 (V1≤V2)
TRANSFER IMAGE, FIX IMAGE, DISCHARGE SHEET
F117
FINISH PRINT JOB
F118
END

SHEET CONVEYANCE DEVICE AND IMAGE FORMING APPARATUS EQUIPPED WITH SHEET CONVEYANCE DEVICE

BACKGROUND OF THE INVENTION

Field of the Invention

The present invention relates to a sheet conveyance device that conveys a sheet and an image forming apparatus that forms an image on a sheet.

Description of the Related Art

Some sheet conveyance devices employed in image forming apparatuses, such as a printer, a copying machine, and a multifunction apparatus, correct skew of a sheet by abutting a front end of a sheet to a nip portion of a pair of registration rollers or an abutment member near the registration rollers so as to form a loop in the sheet as described in Japanese Laid-Open Patent Publication (Kokai) No. 2007-106572 (JP 2007-106572A).

The sheet of which the skew is corrected is nipped by the registration rollers and is conveyed. A sheet conveyance speed of upstream conveyance roller pairs of the registration rollers is set to be slightly higher than that of the registration rollers in order not to change the sheet conveyance speed sent out from the registration rollers.

Moreover, a sheet conveyance device is required to convey various sizes of sheets in order to meet diversification of a sheet used as a recording medium in recent years. Since it is necessary to nip a sheet by at least one roller pair in order to convey the sheet, a distance between roller pairs in a conveyance direction becomes small in order to convey a sheet that is short in the conveyance direction.

When the distance between the registration rollers and the upstream conveyance rollers becomes smaller, out-of-plane deformation of a sheet at the time of correcting skew by abutting the front end of the sheet becomes larger. If the sheet conveyance speed of the registration rollers is higher than that of the upstream conveyance rollers, a loop amount becomes still larger. Thereby, the out-of-plane deformation of the sheet also becomes large, and creases may occur when the sheet is nipped by the nip portion of the registration rollers.

SUMMARY OF THE INVENTION

The present invention provides a sheet conveyance device that is capable of reducing occurrence of creases on a sheet and an image forming apparatus equipped with the sheet conveyance device.

Accordingly, an aspect of the present invention provides a sheet conveyance device including a pair of first conveyance rollers that nip and convey a sheet, a pair of second conveyance rollers that are arranged downstream of the first conveyance rollers in a sheet conveyance direction and that nip and convey the sheet, a pair of registration rollers that are arranged downstream of the second conveyance rollers in the sheet conveyance direction and that nip and convey the sheet after correcting skew of the sheet by abutting a front end of the sheet to the registration rollers, a switching mechanism that switches a state of the second conveyance rollers between a contact state where the second conveyance rollers contact and a separated state where the second conveyance rollers are separated, and a control unit configured to control the first conveyance rollers, the second conveyance rollers, the registration rollers, and the switching mechanism. The control unit executes a first conveyance operation that conveys the sheet with the first conveyance rollers and the registration rollers after correcting the skew of the sheet in the separated state of the second conveyance rollers and in a state where a sheet conveyance speed by the registration rollers is higher than a sheet conveyance speed by the first conveyance rollers.

Further features of the present invention will become apparent from the following description of exemplary embodiments with reference to the attached drawings.

BRIEF DESCRIPTION OF THE DRAWINGS

FIG. 13 is a flowchart showing a control method of the image forming apparatus according to the second embodiment.

DESCRIPTION OF THE EMBODIMENTS

Figure 1:
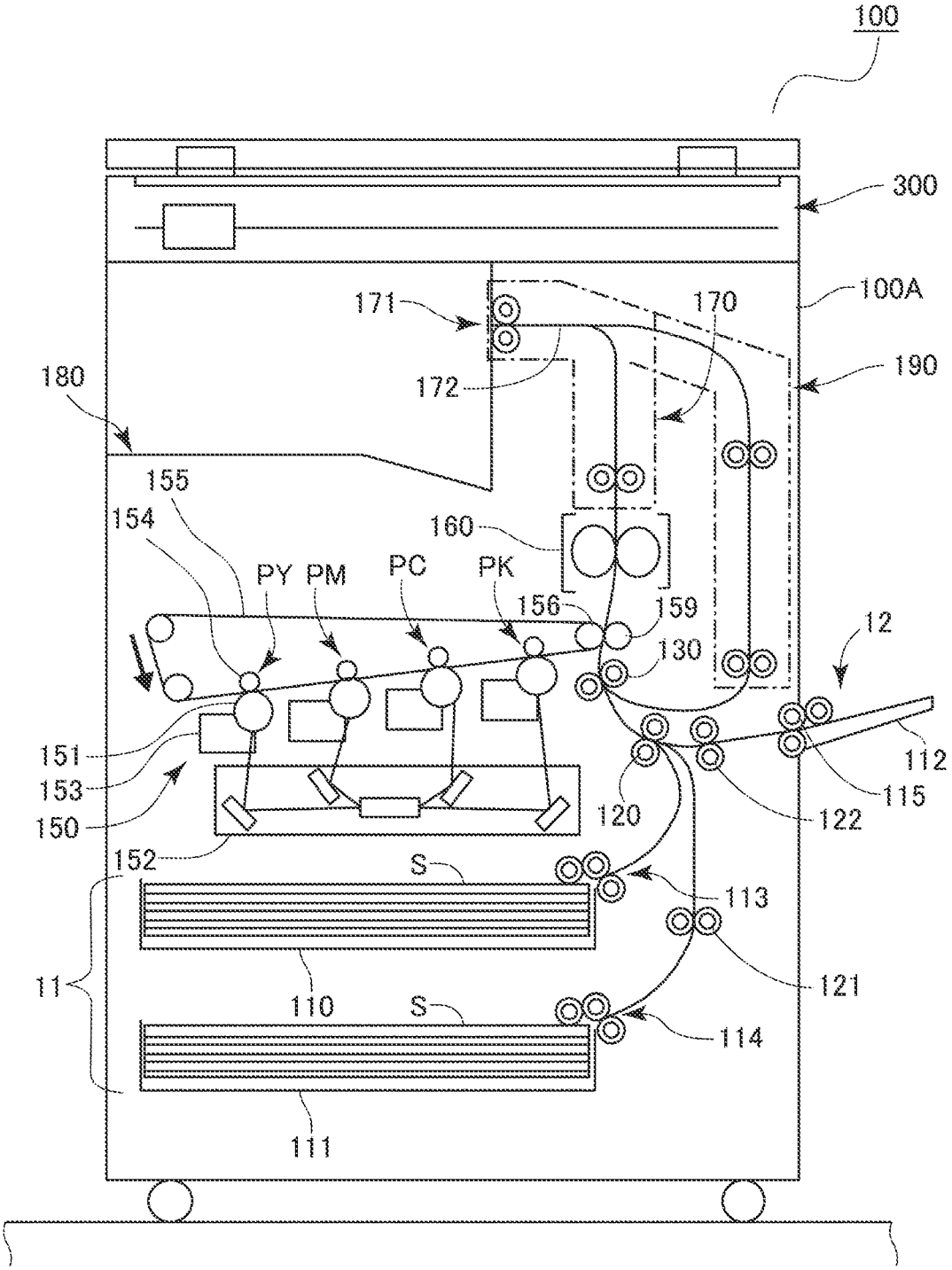
FIG. 1 is a schematic diagram of an image forming apparatus according to a first embodiment.

Hereafter, embodiments according to the present invention will be described in detail by referring to the drawings.

An image forming apparatus includes a printer, a copying machine, a facsimile machine, and a multifunction apparatus. The image forming apparatus forms an image on a sheet, which is used as a recording medium, on the basis of image information input from an external PC or image information read from a document. A sheet used as a recording medium includes a paper sheet, a paper envelope, a plastic film for an overhead projector, and cloth.

As shown in FIG. 1, the image forming apparatus 100 according to the first embodiment is provided with an apparatus body 100A that contains an image forming device 150 and an image reading device 300 that is arranged on the apparatus body 100A and reads image information of a document. The image forming device 150 that is an example of an image forming unit is configured as an intermediate transfer tandem system including four image forming units PY, PM, PC, and PK, and an intermediate transfer belt 155. The image forming device 150 transfers toner images formed by the image forming units PY through PK to a sheet S through the intermediate transfer belt 155. Since configurations of the image forming units PY through PK are basically identical except colors of toners used for development, a configuration and toner-image forming operation of the yellow image forming unit PY will be described as an example.

When the image forming unit PY forms a toner image, a photosensitive drum 151 that is a photosensitive member is rotationally driven and a charging device electrifies the surface of the photosensitive drum 151 uniformly. An exposure device 152 provided in a lower section of the apparatus body 100A irradiates the photosensitive drum 151 with a laser beam modulated according to image information to expose a drum surface and to form an electrostatic latent image on the photosensitive drum 151. Then, the electrostatic latent image is visualized (developed) by the toner supplied from the development device 153*a* so that a toner image is formed on the surface of the photosensitive drum 151.

Similarly, the image forming units PM, PC, and PK form toner images of the respective colors on the photosensitive drums. The toner images formed on the photosensitive drums 151 by the image forming units PY through PK are primarily transferred to the intermediate transfer belt 155 that is an intermediate transfer medium by primary transfer rollers 154. The single color images are overlapped on the intermediate transfer belt 155 so as to form a full color toner image. Adhering substances like residual toner on the photosensitive drums 151 are removed by cleaning devices provided in the respective image forming units PY through PK.

The intermediate transfer belt 155 is wound around a secondary transfer internal roller 156, a tension roller 157, and a stretching roller 158, and is rotationally driven counterclockwise in FIG. 1. The full color toner image borne by the intermediate transfer belt 155 is conveyed towards a secondary transfer section formed between the intermediate transfer belt 155 and a secondary transfer roller 159 that faces the secondary transfer internal roller 156.

In parallel to the above-mentioned image forming process, a feeding movement that feeds the sheet S toward the secondary transfer section from a cassette feed unit 11 or a multiple feed unit 12 (called a manual feed part) is executed. The cassette feed unit 11 includes a first cassette 110 and second cassette 111 as sheet containers. Moreover, the cassette feed unit 11 includes feed units 113 and 114 that are respectively provided in the first cassette 110 and the second cassette 111. The multiple feed unit 12 has a multiple tray 112 that is protruded to the outside of the apparatus body 100A as a sheet support part that supports a sheet, and a feed unit 115. A user can place a necessary sheet on the multiple tray 112 when operating the image forming apparatus to execute the image forming operation. In the meantime, the first cassette 110 and the second cassette 111 can store a huge number of frequently-used sheets (for example, A4 plain paper).

Each of the feed units of the cassette feed unit 11 and multiple feed unit 12 includes a pickup roller that picks up sheets from the cassette or the tray and a pair of separation rollers that receive the sheets from the pickup roller and convey a sheet one by one while separating a sheet from the received sheets. A separation mechanism of the separation rollers may be configured to abut a retard roller to which driving force against the rotation of the pickup roller is input through a torque limiter to a feed roller that conveys a sheet in the same direction of the pickup roller. The separation mechanism is not limited to the above configuration; it may be replaced by another feed mechanism of a separation pad method or an air feeding method.

The sheet S stored in the first cassette 110 is conveyed by the feed unit 113 to a pair of registration rollers 130 through a pair of pre-registration rollers 120. The sheet S stored in the second cassette 110 is fed by the feed unit 114 and is conveyed to the pre-registration rollers 120 and the registration rollers 130 via a pair of extraction rollers 121. The sheet set on the multiple tray 112 is fed by the feed unit 115 and is conveyed to the pre-registration rollers 120 and the registration rollers 130 via a pair of extraction rollers 122. It should be noted that only the pre-registration rollers 120 are arranged on the conveyance path from the feed unit 113 of the first cassette 110 to the registration rollers 130. The pairs of extraction rollers 121 and 122 are pairs of first conveyance rollers in this embodiment. And the pair of pre-registration rollers 120 are a pair of second conveyance rollers in this embodiment.

When the front end of the sheet S abuts to the registration rollers 130 that are in a stopped state, the sheet S forms a bend (loop). Thereby, the front end of the sheet S follows the nip portion of the registration rollers 130, and skew of the sheet is corrected. After that, the registration rollers 130 start conveyance of the sheet S at a timing synchronized with the image forming process by the image forming device 150 and conveys the sheet S to the secondary transfer section. It should be noted that the skew correction mechanism is not limited to the above mechanism where the front end of the sheet is abutted to the nip portion of the registration rollers 130. An abutment member (a shutter member) to which the front end of the sheet S is abutted to correct skew may be provided near the nip portion of the registration rollers 130.

In the secondary transfer section, the toner image borne by the intermediate transfer belt 155 is secondarily transferred to the sheet S by the secondary transfer roller 159. Adhering substances like residual toner on the intermediate transfer belt 155 are removed by a belt cleaning device. After that, the sheet S to which the toner image is transferred is passed to the fixing device 160. The fixing device 160 has a pair of fixing rollers that nip and convey the sheet S and a heating means, such as a halogen lamp or a ceramic heater, that heats the sheet S. The fixing device 160 applies heat and pressure to the toner image while conveying the sheet S. Thereby, the toner melts and adheres and is fixed to the sheet S.

The sheet S on which the image is formed by passing the secondary transfer section and the fixing device 160 is passed to an ejection path 172 of a sheet ejection section 170 and is ejected by a pair of ejection rollers 171 to an ejection tray 180 that is provided between the apparatus body 100A and the image reading device 300. When double-sided printing is performed, the sheet S to which the image is formed on the first surface is switched back and conveyed by the ejection rollers 171 that function as reversing rollers, is passed to a double-sided conveyance section 190, and is conveyed by a pair of conveyance rollers 193 through a double-sided path 192. Then, the image forming device 150 forms an image on a second surface of the sheet S that reaches the registration rollers 130 again, and the sheet S is ejected to the ejection tray 180 by the ejection rollers 171.

Figure 2:
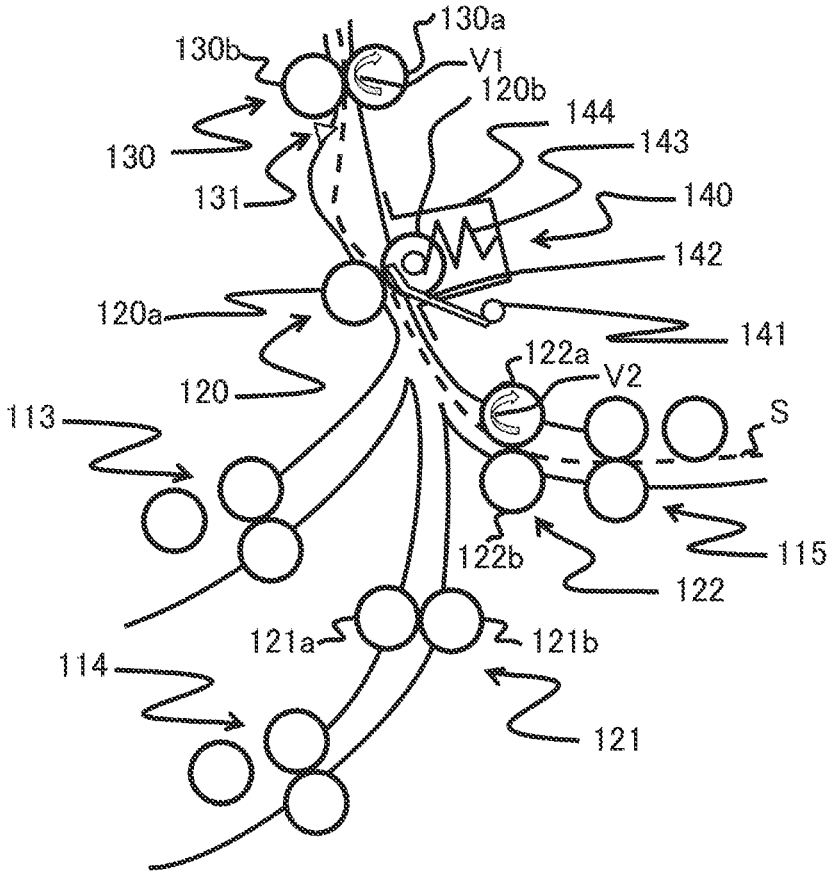
FIG. 2 is a view showing a state where a pair of pre-registration rollers according to the first embodiment are abutted.
Figure 3:
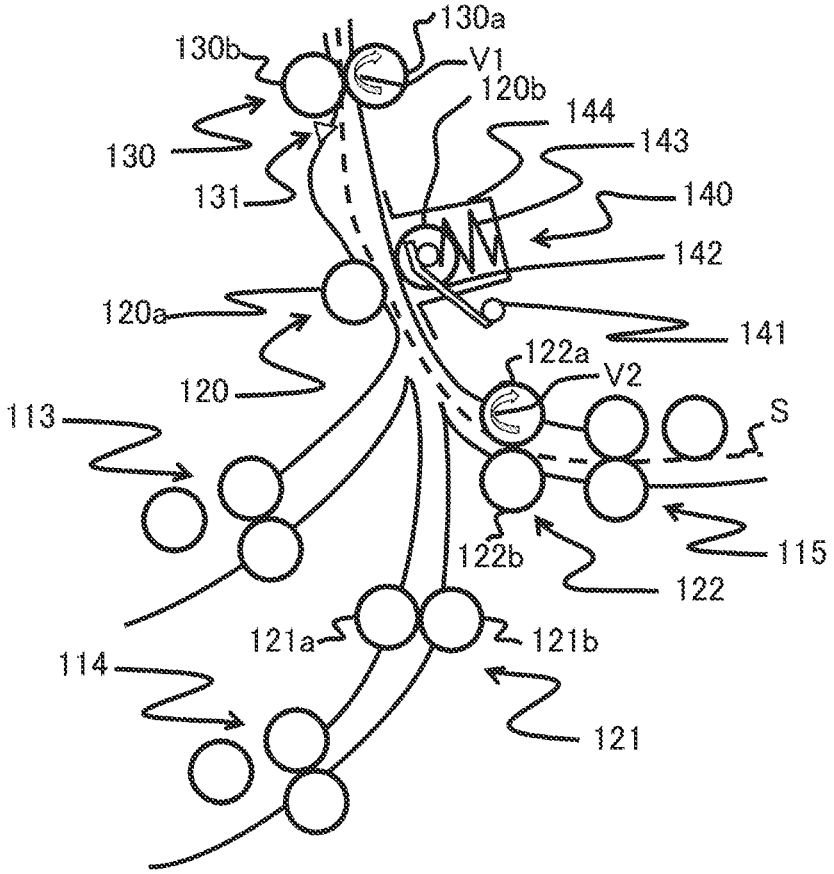
FIG. 3 is a view showing a state where the pre-registration rollers according to the first embodiment are separated.
Figure 4:
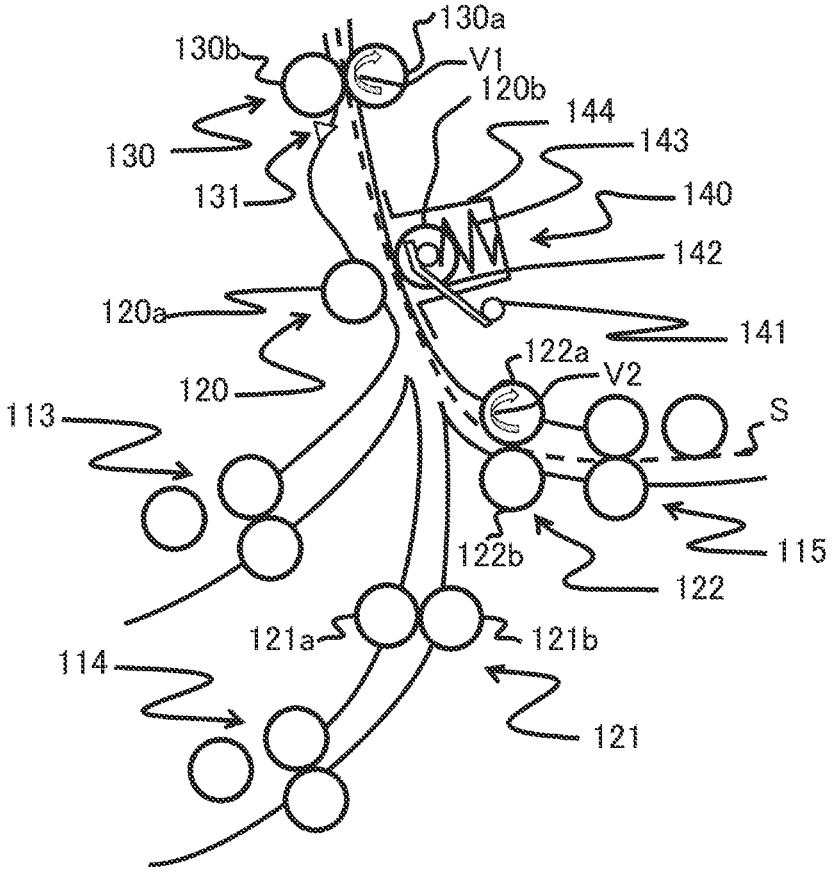
FIG. 4 is a view showing a state where the pre-registration rollers according to the first embodiment are separated and where a sheet conveyance speed of a pair of extraction rollers is slower than that of a pair of registration rollers.
Figure 5:
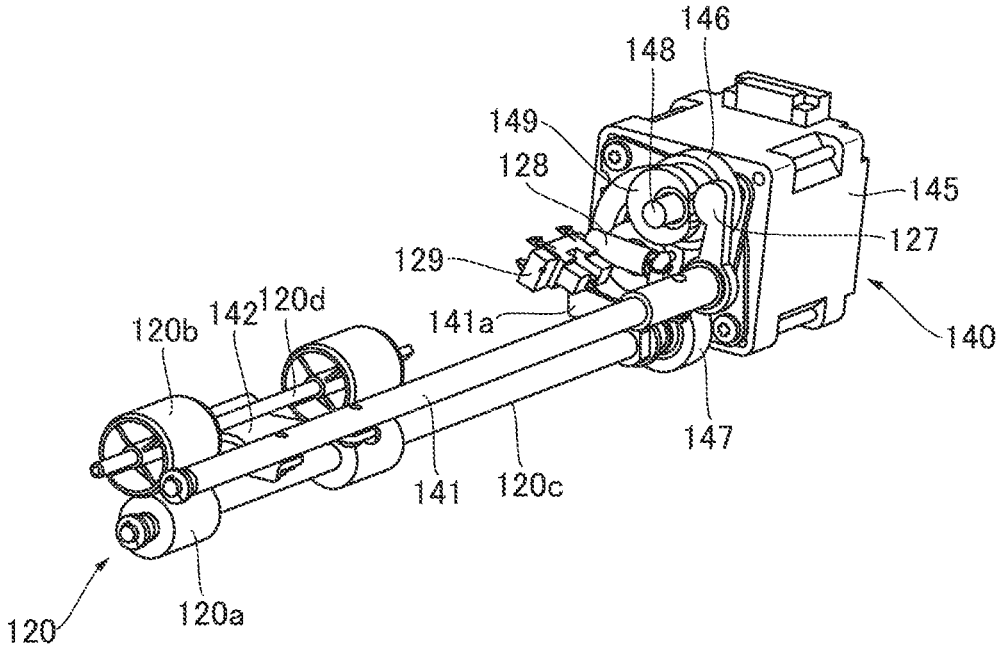
FIG. 5 is a view showing a drive mechanism of the pre-registration rollers according to the first embodiment in an abutted state.
Figure 6:
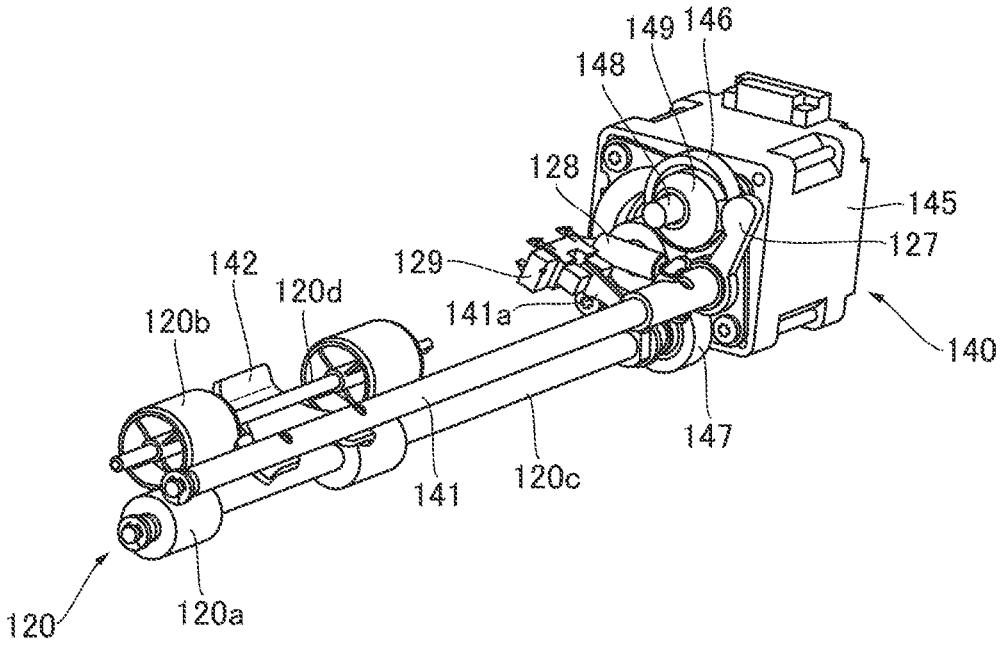
FIG. 6 is a view showing the drive mechanism of the pre-registration rollers according to the first embodiment in a separated state.

Next, the registration rollers 130 and a sheet conveyance mechanism at its upstream in the image forming apparatus 100 according to the first embodiment will be described using FIG. 2 through FIG. 10. FIG. 2 and FIG. 3 are schematic diagrams showing the sheet conveyance mechanism. FIG. 2 shows a contact state where the pre-registration rollers 120 contact. FIG. 3 shows a separated state where the pre-registration rollers 120 are separated. A broken line in the drawing shows the sheet S that is fed from the multiple feed unit 12. FIG. 4 shows a state where the pre-registration rollers 120 are separated and where a sheet conveyance speed V2 of the extraction rollers is slower than a sheet conveyance speed V1 of the registration rollers. FIG. 5 and FIG. 6 are views showing the drive mechanism of the pre-registration rollers 120 including a switching mechanism 140 that switches a state of the pre-registration rollers 120 between the contact state where the pre-registration rollers 120 contact and the separated state where the pre-registration rollers 120 are separated. FIG. 5 shows the contact state where the pre-registration rollers 120 contact and FIG. 6 shows the separated state where the pre-registration rollers 120 are separated.

Components included in the sheet conveyance mechanism will be described first using FIG. 2 and FIG. 3. The extraction rollers 121 consist of an extraction drive roller 121*a* that is driven by a motor and an extraction driven roller 121*b* that rotates following the extraction drive roller 121*a*. The extraction rollers 122 consist of an extraction drive roller 122*a* that is driven by a motor and an extraction driven roller 122*b* that rotates following the extraction drive roller 122*a*. The pre-registration rollers 120 consist of a pre-registration drive roller 120*a* that is driven by a motor and a pre-registration driven roller 120*b* that rotates following the pre-registration drive roller 120*a*. The pre-registration rollers 120 can contact and can be separated by the switching mechanism 140. The registration rollers 130 consists of a registration drive roller 130*a* that is driven by a motor and a registration driven roller 130*b* that rotates following the registration drive roller 130*a*.

In the image forming apparatus 100, a sheet sensor 131 that is a detection unit that can detect a sheet S is arranged at a detection position between the pre-registration rollers 120 and the registration rollers 130. The sheet sensor 131 may be a reflection-type photoelectric sensor that irradiates a sheet conveyance path and detects reflected light from the sheet S or a transmission-type photoelectric sensor that detects rotation of a flag protruded to the sheet conveyance path.

It should be noted that the image forming apparatus 100 according to this embodiment employs a vertical conveyance type configuration (see FIG. 1) that forms an image to the sheet S that is conveyed upwardly inside the apparatus body 100A. Then, the sheet S fed from the multiple feed unit 12 arranged on the side surface of the apparatus body 100A is conveyed toward the secondary transfer section through a curved sheet conveyance path. That is, as shown in FIG. 2, the sheet conveyance path is curved toward the approximately vertical direction from the approximately horizontal direction between the extraction rollers 122 and the registration rollers 130 when viewed in a width direction that intersects perpendicularly with the sheet conveyance direction. The sheet conveyance path between the pre-registration rollers 120 and the registration rollers 130 has a portion projecting outwardly (leftward in FIG. 2) of the curved shape. This forms a space that allows forming a bend (loop) of a sheet that is abutted to the registration rollers 130.

Incidentally, the sheet conveyance device used for an image forming apparatus is required to stably convey various sizes of sheets in order to meet diversification of a sheet used as a recording medium. Specifically, a distance between conveyance roller pairs in the sheet conveyance direction is set up narrowly so that a small sheet (for example, a postcard) will be certainly passed from the upstream conveyance roller pair to the downstream conveyance roller pair. In this embodiment, the distance between the pre-registration rollers 120 and the registration rollers 130 in the sheet conveyance direction is set to be shorter than a length of a sheet that is shortest in the sheet conveyance direction among sheets that can be subjected to image formation and conveyance by the image forming apparatus 100.

In this embodiment, the pre-registration rollers 120 can be separated (a nip portion can be opened) if needed.

Hereinafter, the configuration of the switching mechanism 140 of the pre-registration rollers 120 will be described.

As shown in FIG. 5 and FIG. 6, the switching mechanism 140 includes a separation gear 146, separation transfer shaft 148, cam 149, lever 127, posture fixing spring 128, separation shaft 141, separation arm 142, separation sensor 129. The switching mechanism 140 is driven by a pre-registration drive motor 145 that is a common driving source to the pre-registration rollers 120. The switching mechanism 140 switches the state of the pre-registration rollers 120 between the contact state and the separated state by operating a rotation shaft 120*d* of the pre-registration driven roller 120*b*.

The separation gear 146 and the cam 149 are supported by the separation transfer shaft 148, and the cam 149 integrally rotates with the separation gear 146 because the separation gear 146 rotates by the pre-registration drive motor 145. The cam 149 rotates the separation shaft 141 by pressing the lever 127 provided in the separation shaft 141. The posture fixing spring 128 connected to the separation shaft 141 is energizing the separation shaft 141 so that the lever 127 will be pushed to the cam 149. The separation arm 142 that is a swinging member attached to the separation shaft 141 swings in association with movement of the lever 127 and moves the rotation shaft 120*d* of the pre-registration driven roller 120*b* in an approaching and separating direction with respect to the pre-registration drive roller 120*a*. The separation sensor 129 is a transmission-type photoelectric sensor that can detect a flag member 141*a* provided in the separation shaft 141. The separation sensor 129 detects rotation angles of the separation shaft 141 corresponding to the contact state (FIG. 5) and the separated state (FIG. 6) of the pre-registration rollers 120. It should be noted that the separation sensor 129 is an example of a position detection unit that can detect the contact state and the separated state of the pre-registration rollers 120. For example, the separation sensor 129 may be replaced with a configuration that detects the position of the rotation shaft 120*d* of the pre-registration driven roller 120*b*.

Moreover, as shown in FIG. 2, the pre-registration rollers 120 are pressurized with the pressurizing spring 143 that is an elastic member provided between the rotation shaft 120*d* of the pre-registration driven roller 120*b* and a sheet metal 144 fixed to a frame of the image forming apparatus 100. The pressurizing spring 143 is an example of a pressurizing member that pressurizes one roller of the pre-registration rollers 120 to the other roller and prescribes a contact pressure (nip pressure) in the contact state of the pre-registration rollers 120.

Figure 7:
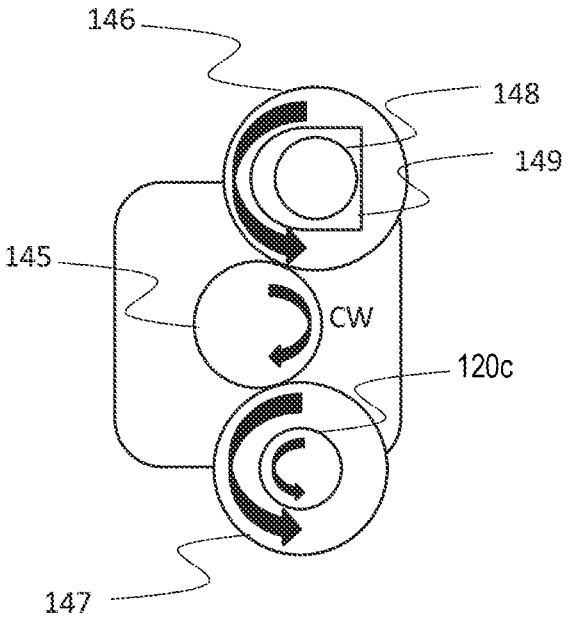
FIG. 7 is a schematic view showing the drive mechanism in a state where the pre-registration rollers according to the first embodiment are rotated.
Figure 8:
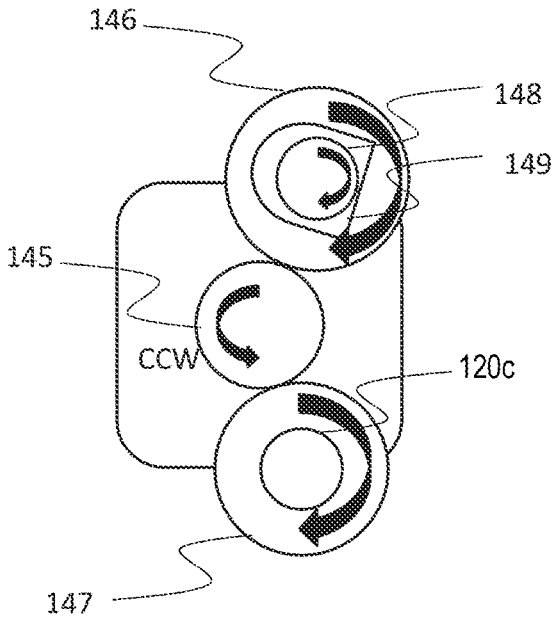
FIG. 8 is a schematic view showing the drive mechanism in a state where a switching mechanism according to the first embodiment is operated.

As shown in FIG. 7 and FIG. 8, an output gear of the pre-registration drive motor 145 meshes with both the pre-registration drive gear 147 attached to a drive shaft 120*c* of the pre-registration drive roller 120*a* and the above-mentioned separation gear 146. Hereinafter, the rotational direction of the pre-registration drive motor 145 in a clockwise direction when viewed from an output shaft of the motor 145 is denoted as a CW direction and a counter clockwise direction opposite to the CW direction is denoted as a CCW direction. The pre-registration drive gear 147 is provided with a one-way clutch mechanism that transmits the driving force of the pre-registration drive motor 145 to the drive shaft 120*c* only when an output gear rotates to a CW direction. Moreover, the separation gear 146 is provided with the one-way clutch mechanism which transmits driving force of the pre-registration drive motor 145 to the separation transfer shaft 148 only when the output gear rotates in the CCW direction.

When the pre-registration drive motor 145 rotates in the CW direction (first direction), the driving force is transmitted to the drive shaft 120*c* through the pre-registration drive gear 147 and the pre-registration rollers 120 is drivingly rotated. At this time, the driving force is not transmitted to the separation transfer shaft 148 and the switching mechanism 140 does not operate. In the meantime, when the pre-registration drive motor 145 rotates in the CCW direction (second direction), the driving force is transmitted to the separation transfer shaft 148 through the separation gear 146, and the switching mechanism 140 switches the state of the pre-registration rollers 120 between the contact state and the separated state. That is, when the cam 149 rotates, the lever 127 that is pressed to the cam 149 swings. The swing operation is transmitted to the separation arm 142 through the separation shaft 141, and accordingly, the pre-registration driven roller 122*b* contacts the pre-registration drive roller 120*a* (FIG. 5) and is separated from the pre-registration drive roller 120*a* (FIG. 6). At this time, the driving force is not transmitted to the drive shaft 120*c*, and the pre-registration rollers 120 are not rotated. In this way, the drive mechanism of the pre-registration rollers 120 according to this embodiment switches the rotational drive of the pre-registration rollers 120 and the drive of the switching mechanism 140 by switching the rotational direction of the pre-registration drive motor 145 that consists of a single motor.

Next, a conveyance operation that the sheet conveyance mechanism can execute will be described by referring to FIG. 2 through FIG. 4. The sheet conveyance mechanism of this embodiment conveys a sheet by executing one of a plurality of conveyance operations (modes) mentioned below based on an attribute (for example, information about a size, a basis weight, etc.) of a sheet and a feed source of a sheet (a sheet feed source). Although the conveyance operation for the sheet S fed from the multiple feed unit 12 will be mainly described below, the same conveyance operation can be basically executed for the sheet S fed from the cassette feed unit 11 unless otherwise mentioned.

FIG. 2 shows a situation of a conveyance operation (a third conveyance operation in this embodiment) that conveys the sheet S in the contact state of the pre-registration rollers 120. In this conveyance operation, the sheet S conveyed by the extraction rollers 122 is nipped by the pre-registration rollers 120 and is further conveyed. Then, skew of the front end of the sheet S is corrected because the front end of the sheet S is abutted to the nip portion of the stopped registration rollers 130 to form a loop between the pre-registration rollers 120 and the registration rollers 130.

Moreover, in this conveyance operation, the sheet S is conveyed in the contact state of the pre-registration rollers 120 even after the skew correction of the sheet S. Accordingly, when the conveyance of the registration rollers 130 is started after the skew correction of the sheet S, the pre-registration rollers 120 convey the sheet S together with the registration rollers 130. At this time, a sheet conveyance speed V2 (a circumferential surface speed of the drive roller when speed fluctuation due to conveyance resistance of a sheet, etc. is disregarded) of the pre-registration rollers 120 is equivalent to or slightly higher than a sheet conveyance speed V1 of the registration rollers 130 in order to avoid mutual pulling of the sheet.

This conveyance operation has an advantage of correcting the skew certainly by pushing the front end of the sheet into the nip portion of the registration rollers 130 and an advantage capable of conveying the sheet stably by assistance of the pre-registration rollers 120 even when the sheet is a thick paper sheet of which the conveyance resistance is relatively large. Moreover, since the speed fluctuation of the sheet sent out from the registration rollers 130 due to the mutual pulling of the sheet is avoided, image quality of the image transferred to the sheet at the secondary transfer section is improved.

FIG. 3 shows a situation of a conveyance operation (a second conveyance operation in this embodiment) that conveys the sheet S in the separated state of the pre-registration rollers 120.

In this conveyance operation, the front end of the sheet S conveyed by the extraction rollers 122 passes through the pre-registration rollers 120 in the separated state and is abutted to the nip portion of the stopped registration rollers 130. When the extraction rollers 122 further conveys the sheet S, the skew of the sheet S is corrected by forming a loop between the extraction rollers 122 and the registration rollers 130.

Moreover, in this conveyance operation, the sheet S is conveyed in the separated state of the pre-registration rollers 120 even after the skew correction of the sheet S. Accordingly, when the conveyance of the registration rollers 130 is started after the skew correction of the sheet S, the extraction rollers 122 convey the sheet S together with the registration rollers 130. At this time, the sheet conveyance speed V2 of the extraction rollers 122 is equivalent to or slightly higher than the sheet conveyance speed V1 of the registration rollers 130.

According to this conveyance operation, the distance between roller pairs in which a loop is formed becomes longer than that shown in FIG. 2. The loop is formed within the short conveyance path from the pre-registration rollers 120 to the registration rollers 130 in the state shown in FIG. 2. In the meantime, in this conveyance operation, the loop is formed within the conveyance path from the extraction rollers 122 to the registration rollers 130 as shown in FIG. 3. Accordingly, out-of-plane deformation of the sheet S accompanying with the skew correction is mitigated, and a possibility that creases will occur on the sheet S is reduced. Moreover, since the speed fluctuation of the sheet sent out from the registration rollers 130 due to the mutual pulling of the sheet is avoided, image quality of the image transferred to the sheet at the secondary transfer section is improved.

FIG. 4 shows a situation of a conveyance operation (a first conveyance operation in this embodiment) that conveys the sheet S in the separated state of the pre-registration rollers 120 and in a state where the sheet conveyance speed of the extraction rollers 122 after the skew correction is lower than the sheet conveyance speed of the registration rollers 130.

This conveyance operation is similar to the case shown in FIG. 3 on the point where the skew correction of the sheet S and the conveyance after the skew correction are performed in the separated state of the pre-registration rollers 120. Accordingly, out-of-plane deformation of the sheet S accompanying with the skew correction is mitigated, and a possibility that creases will occur on the sheet S is reduced.

Furthermore, in this conveyance operation, the sheet conveyance speed of the extraction rollers 122 after the skew correction is lower than the sheet conveyance speed of the registration rollers 130. That is, after the skew correction, the sheet S is conveyed by the registration rollers 130 and the extraction rollers 122 in the state where the sheet conveyance speed V1 of the registration rollers 130 and the sheet conveyance speed V2 of the extraction rollers 122 satisfy V1>V2. Thereby, the loop formed between the registration rollers 130 and the extraction rollers 122 decreases (disappears) gradually as the sheet S is conveyed until the rear end of the sheet S passes through the extraction rollers 122. Then, since the posture of the rear side of the sheet follows the posture of the front side of the sheet that is nipped by the registration rollers 130, tilt tends to be cancelled and the out-of-plane deformation of the sheet S decreases. As a result, the out-of-plane deformation of the sheet S is further mitigated, and the possibility that creases will occur on the sheet S is further reduced.

In this way, in the first conveyance operation of this embodiment, since the sheet is conveyed by the registration rollers 130 and the extraction rollers 122 in the separated state of the pre-registration rollers 120 and in the state where the sheet conveyance speeds after the skew correction satisfy V1>V2, the possibility that creases will occur on the sheet is reduced.

Moreover, in this embodiment, the plurality of conveyance operations are switchable. The conveyance operations are different in the state of the pre-registration rollers 120 (the contact state or the separated state) and are different in the relations between the conveyance speed of the registration rollers 130 and the conveyance speed of the upstream rollers 120 and 122. The second conveyance operation shown in FIG. 3 has a higher effect to reduce occurrence of creases than the third conveyance operation shown in FIG. 2. Moreover, the first conveyance operation shown in FIG. 4 has a still higher effect to reduce occurrence of creases than the second conveyance operation shown in FIG. 3.

The reason why the second conveyance operation has the higher effect to reduce occurrence of creases than the third conveyance operation is that the out-of-plane deformation of the sheet at the time of abutting the front end of the sheet to the nip portion of the registration rollers is reduced because the distance between the roller pairs that nip the sheet becomes large in the separated state of the pre-registration rollers. Furthermore, the reason why the first conveyance operation has the higher effect to reduce occurrence of creases than the second conveyance operation is that the out-of-plane deformation of the sheet at the time of conveying the sheet by the registration rollers is reduced because the conveyance speeds satisfy V1>V2.

Accordingly, the possibility that creases will occur can be reduced by switching the conveyance operations according to sheet supply conditions of the image forming operation like the attribute of the sheet while maintaining a conveyance property and a skew correction capability.

Figure 9:
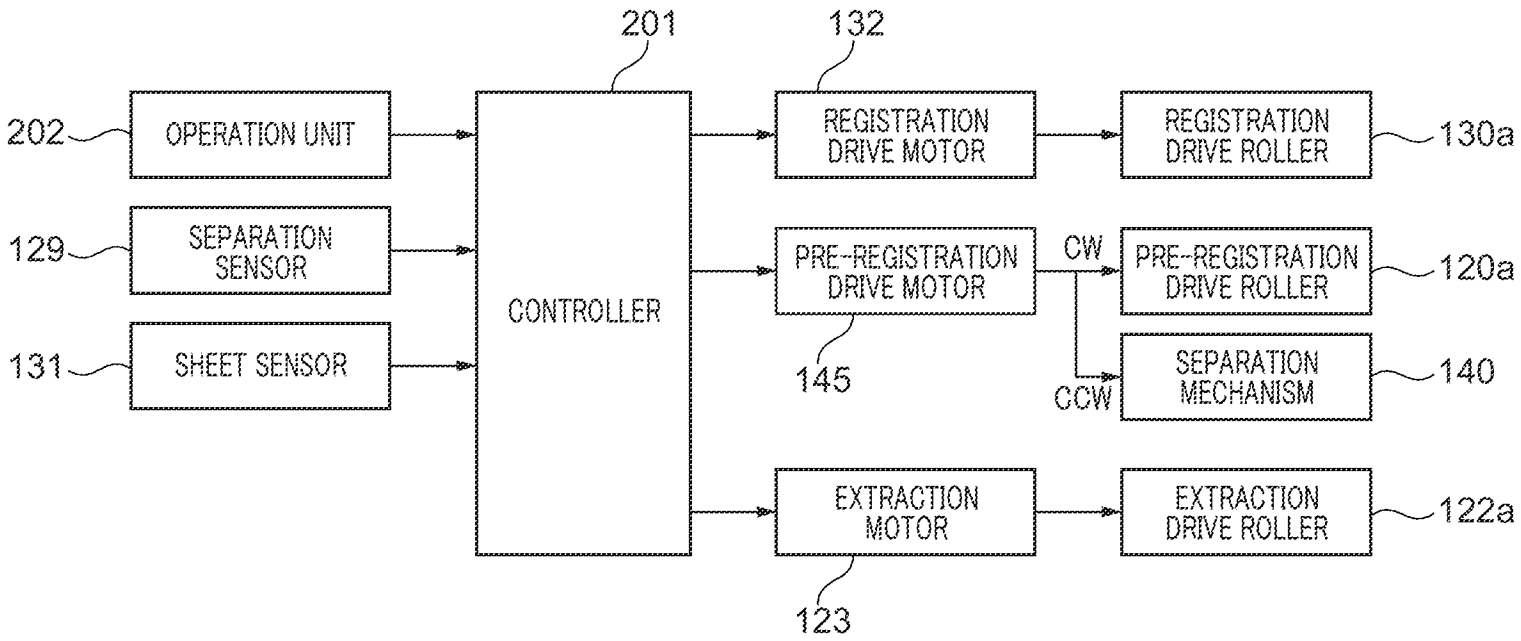
FIG. 9 is a block diagram showing a control configuration of the image forming apparatus according to the first embodiment.

Hereinafter, an example of the control method for the sheet conveyance operation by the image forming apparatus 100 will be described by referring to FIG. 9 and FIG. 10. As shown in FIG. 9, the image forming apparatus 100 is equipped with a controller 201 that is an example of a control unit. The controller 201 includes a memory that stores data and programs and a Central Processing Unit (CPU) as an execution unit that runs the programs. The controller 201 receives signals from the separation sensor 129 and sheet sensor 131 and input signals from an operation unit 202 that functions as a user interface including a liquid crystal panel and various kinds of buttons. The controller 201 controls operations of the sheet conveyance mechanism by drivingly controlling actuators, such as a registration drive motor 132, a pre-registration drive motor 145, and an extraction motor 123.

Figure 10:
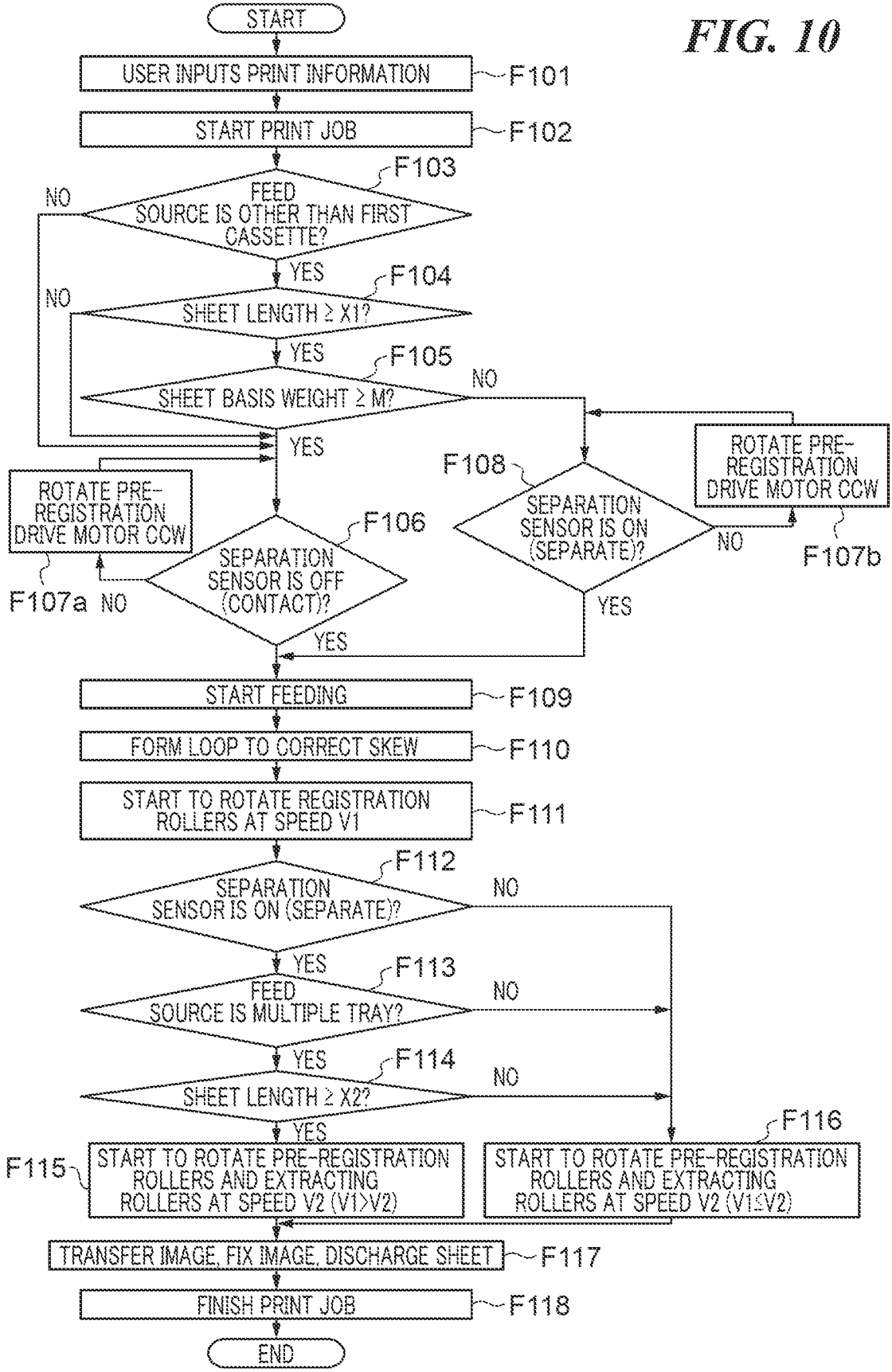
FIG. 10 is a flowchart showing a control method of the image forming apparatus according to the first embodiment.

The CPU achieves a function of each step of the flowchart shown in FIG. 10 by running the program read from the memory. First, print information that is input by a user through the operation unit 202 of the image forming apparatus 100 and that includes information about the sheet S that is used as a recording medium is obtained (F101). The information input in this step includes size and basis weight of the sheet S, for example. When a user's instruction to execute a print job through the operation unit 202 is detected (F102), it is determined whether the pre-registration rollers 120 should be separated (F103, F104, and F105).

Specifically, it is determined whether a sheet feed source used for execution of the print job (the sheet that is subjected to the image forming operation) is other than the first cassette 110 (F103). When the feed source is the first cassette 110 (F103: No), it is determined that the pre-registration rollers 120 need to perform the conveyance operation in the contact state, and a contact operation of the pre-registration rollers 120 is performed (F106, F107*a*). Since no roller pair other than the pre-registration rollers 120 is not arranged on the conveyance path from the feed unit 113 of the first cassette 110 to the registration rollers 130, a poor conveyance of the sheet may occur if the pre-registration rollers 120 are separated. In order to avoid the poor conveyance, the pre-registration rollers 120 are operated in the contact state.

When the feed source is other than the first cassette 110 (F103: Yes), it is determined whether a length of the sheet S in the sheet conveyance direction (hereinafter referred to as a sheet length) is equal to or more than a predetermined threshold X1 (mm) (F104). When the sheet is shorter than the X1 (mm) (F104: No), it is determined that the pre-registration rollers 120 need to perform the conveyance operation in the contact state, and the contact operation (F106, F107*a*) of the pre-registration rollers 120 is performed. This is because the sheet S may not be conveyed to a position where the front end of the sheet reaches the registration rollers 130 in the separated state of the pre-registration rollers 120 when the sheet S is short. Accordingly, the threshold X1 may be obtained by adding some margin to the distance from the extraction rollers 122 to the registration rollers 130 measured along the conveyance path.

When the sheet length is equal to or more than X1 (mm) (F103: Yes), it is determined whether the basis weight of the sheet S is equal to or more than a predetermined threshold M (gsm) (F105). When the basis weight of the sheet S is less than M (gsm) (F105: No), it is determined that the pre-registration rollers 120 should be separated, and a separating operation of the pre-registration rollers 120 is performed (F107*b*, F108). This is because the sheet S of the small basis weight is low in rigidity and its crease generation risk is relatively high. In the meantime, when the basis weight of the sheet S is equal to or more than M (gsm) (F105: Yes), it is determined that the pre-registration rollers 120 should contact, and the contact operation of the pre-registration rollers 120 is performed (F106, F107*a*).

In the contact operation (F106, F107*a*) of the pre-registration rollers 120, the pre-registration drive motor 145 is rotated in the CCW direction (FIG. 8) until the output signal of the separation sensor 129 represents the contact state of the pre-registration rollers 120 (an OFF signal in this embodiment). Then, the switching mechanism 140 mentioned above operates and the pre-registration rollers 120 are brought into the contact state. When the output signal of the separation sensor 129 represents the contact state of the pre-registration rollers 120 from the beginning, the process proceeds to a next step without rotating the pre-registration drive motor 145 in the CCW direction.

In the separating operation (F108, F107*b*) of the pre-registration rollers 120, the pre-registration drive motor 145 is rotated in the CCW direction (FIG. 8) until the output signal of the separation sensor 129 represents the separated state of the pre-registration rollers 120 (an ON signal in this embodiment). Then, the switching mechanism 140 mentioned above operates and the pre-registration rollers 120 are brought into the separated state. When the output signal of the separation sensor 129 represents the separated state of the pre-registration rollers 120 from the beginning, the process proceeds to a next step without rotating the pre-registration drive motor 145 in the CCW direction.

In this way, when a sheet having a first basis weight that is less than M and having a third length that is equal to or more than X1 in the sheet conveyance direction is conveyed, the switching mechanism 140 brings the pre-registration rollers 120 into the contact state in this embodiment. In this case, the first conveyance operation (F115) or the second conveyance operation (F116) is performed in the separated state of the pre-registration rollers 120 even after the skew correction as mentioned later. In the meantime, when a sheet having a second basis weight that is equal to or more than M and is larger than the first basis weight is conveyed, the switching mechanism 140 brings the pre-registration rollers 120 into the contact state. Moreover, when a sheet having a fourth length that is less than X1 and is shorter than the third length in the sheet conveyance direction is conveyed, the switching mechanism 140 brings the pre-registration rollers 120 into the contact state. In these cases, the sheet is conveyed in the contact state of the pre-registration rollers 120 as the third conveyance operation (F116) after the skew correction as mentioned later.

When the contact state or the separated state of the pre-registration rollers 120 is determined by the above-mentioned process in F103 through F108, the feed operation that feeds the sheet S from a cassette or a tray as the feed source is started (F109). When the feed source is the multiple tray 112, the sheet S on the multiple tray 112 is fed by the feed unit 115 and it is conveyed towards the registration rollers 130 through the extraction rollers 122. At this time, when the pre-registration rollers 120 are in the contact state, the pre-registration drive motor 145 is rotated in the CW direction to convey the sheet S also by the pre-registration rollers 120. When the pre-registration rollers 120 are in the separated state, the pre-registration drive motor 145 may be rotated in the CW direction or may be stopped. Since the circumferential surface of the pre-registration drive roller 120*a* is projected into the conveyance path in the separated state (FIG. 3), it is suitable to rotate the pre-registration drive motor 145 in the CW direction so that the pre-registration drive roller 120*a* will rotate in the speed that is identical to the speed of the extraction rollers 122.

After that, since the front end of the sheet S is abutted to the stopped registration rollers 130 and the loop of the sheet S is formed, the skew of the sheet S is corrected (F110) at the registration rollers 130 as mentioned above. At this time, when the pre-registration rollers 120 are in the contact state, the loop is formed between the pre-registration rollers 120 and the registration rollers 130. When the pre-registration rollers 120 are in the separated state, the loop is formed between the extraction rollers 122 and the registration rollers 130. A loop size (a sheet feed amount by the upstream roller pair after the front end of the sheet reaches the registration rollers 130) is managed on the basis of elapsed time from a detection timing of the front end of the sheet by the sheet sensor 131 and the sheet conveyance speed of the upstream roller pair.

When the loop of a predetermined size is formed, the rotations of the extraction rollers 122 and pre-registration rollers 120 are suspended. After that, the registration rollers 130 start rotating at the sheet conveyance speed V1 (F111) at a timing synchronizing with the image forming process by the image forming device 150. The pre-registration rollers 120 and the extraction rollers 122 at the upstream side start rotating at the sheet conveyance speed V2 in response to the rotation start of the registration rollers 130. At this time, the sheet conveyance speed V2 is determined by the process in F112 through F114.

Specifically, when the pre-registration rollers 120 are in the separated state (F112: Yes), when the feed source is the multiple tray 112 (F113: Yes), and when the sheet length is equal to or more than a predetermined threshold X2 (mm) (F114: Yes), the sheet conveyance speed V2 is set to be slower than the sheet conveyance speed V1 of the registration rollers 130 (F115). In cases other than the above-mentioned case, the sheet conveyance speed V2 of the pre-registration rollers 120 and extraction rollers 122 is set to be equal to or more than the sheet conveyance speed V1 of the registration rollers 130 (F116). In other words, when the sheet of which the length in the sheet conveyance direction is the first length that is equal to or more than X2 is conveyed, the first conveyance operation (F115) is performed. Moreover, when the sheet of which the length in the sheet conveyance direction is the second length that is less than X2 and is shorter than the first length is conveyed, the second conveyance operation (F116) is performed. Furthermore, when the pre-registration rollers 120 are in the contact state (F112: No), the third conveyance operation (F116) is performed.

The reason why the conveyance speeds satisfy V1>V2 when the feed source is the multiple tray 112 is that the out-of-plane deformation at the time of the skew correction may become large as compared with the sheet fed from the cassette because the user may set the sheet on the multiple tray 112 in a skewed state. The reason why the conveyance speeds satisfy V1>V2 when the sheet length is equal to or more than the threshold X2 is as follows. If the conveyance speeds satisfy V1≤V2 during the conveyance after the skew correction until the sheet rear end passes through the extraction rollers 122, the out-of-plane deformation of the sheet tends to become larger as the sheet length becomes longer.

It should be noted that the threshold X2 of the sheet length about the settings of the sheet conveyance speeds V1 and V2 may be different from the threshold X1 of the sheet length about the determination of whether to separate the pre-registration rollers 120. The threshold X2 is set up from a viewpoint of a crease occurrence risk resulting from the difference between the sheet conveyance speed of the registration rollers 130 and the sheet conveyance speed of the upstream roller pair. For example, X2 is more than X1.

When the sheet S is sent out from the registration rollers 130, an image is transferred to the sheet S in the secondary transfer section. After that, the sheet S is subjected to a fixing process by the fixing device 160 and is ejected to the outside of the image forming apparatus 100 (F117). Thereby, the process of the print job to the sheet is finished (F118). When images are continuously formed on a plurality of sheets, the process in F109 through F117 is repeatedly executed.

Although the registration rollers 130 convey the sheet at the constant sheet conveyance speed V1 after the skew correction in the sheet conveyance operation described in this embodiment, the sheet conveyance speed V1 of the registration rollers 130 after the skew correction may be changed. For example, the sheet conveyance speed V1 may be controlled in order to adjust the timing at which the front end of the sheet reaches the secondary transfer section synchronizing with the image forming process. In that case, the relation V1>V2 or V1≤V2 is satisfied in at least the timing of starting to rotate the pre-registration rollers 120 and extraction rollers 122 in F115 or F116. Moreover, when the sheet conveyance speed V1 of the registration rollers 130 is changed after starting to rotate, the sheet conveyance speed V2 of the pre-registration rollers 120 and extraction rollers 122 is preferably changed so as to maintain the relation V1>V2 or V1≤V2.

Although the pre-registration rollers 120 and extraction rollers 122 are suspended when the loop of the predetermined size is formed during the skew correction in this embodiment, the conveyance by these rollers may be continued. That is, the rotations of the registration rollers 130 may be started at the timing at which the loop of the predetermined size is formed while continuing the rotations of the pre-registration rollers 120 and extraction rollers 122. In that case, the sheet conveyance speed V1 of the registration rollers 130 may be changed in order to adjust the timing at which the front end of the sheet reaches the secondary transfer section.

The determination of whether to separate the pre-registration rollers 120 and the criteria for determining the sheet conveyance speeds V1 and V2 after the skew correction are not limited to what is described in this embodiment. For example, it can be determined whether to separate the pre-registration rollers 120 using a part of the conditions shown in F103 through F105 in FIG. 10. Moreover, the sheet conveyance speeds V1 and V2 after the skew correction may be determined using only one of F113 and F114 in FIG. 10. Even in such a case, the suitable conveyance operation can be executed corresponding to the execution conditions of the image forming operations, such as the attribute of the sheet and the sheet feed source, due to the reasons described in the embodiment.

Moreover, when the sheet conveyance speeds after the skew correction satisfy V1>V2, the pre-registration rollers 120 are always in the separated state in this embodiment. Regardless of this, a mode in which the sheet S is conveyed in the contact state of the pre-registration rollers 120 and in a state where the sheet conveyance speed V2 of the extraction rollers 122 and pre-registration rollers 120 after the skew correction is set to be faster than the sheet conveyance speed V1 of the registration rollers 130 (V1<V2) may be added.

Figure 11:
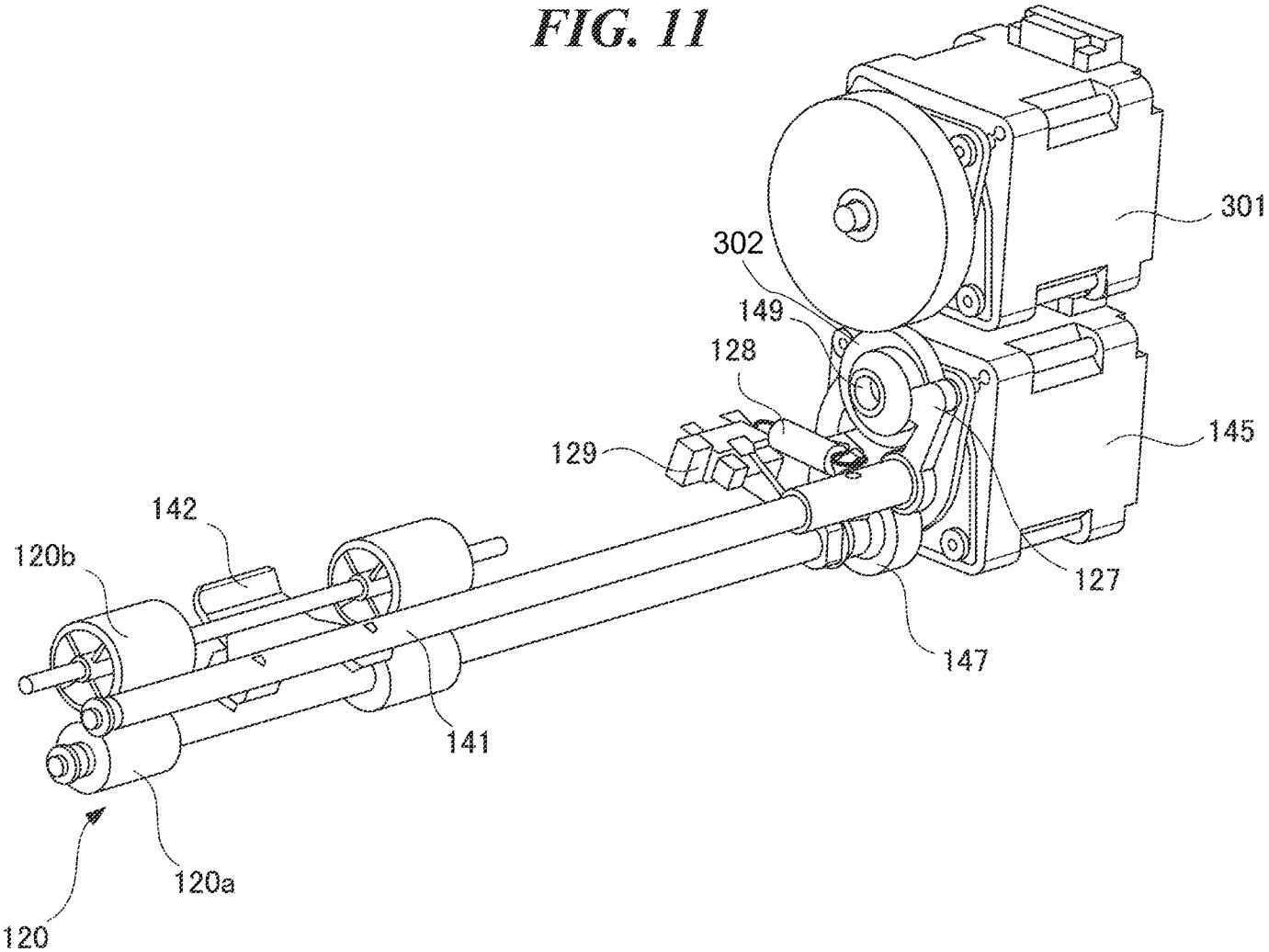
FIG. 11 is a view showing a drive mechanism of a pair of pre-registration rollers according to a second embodiment.
Figure 12:
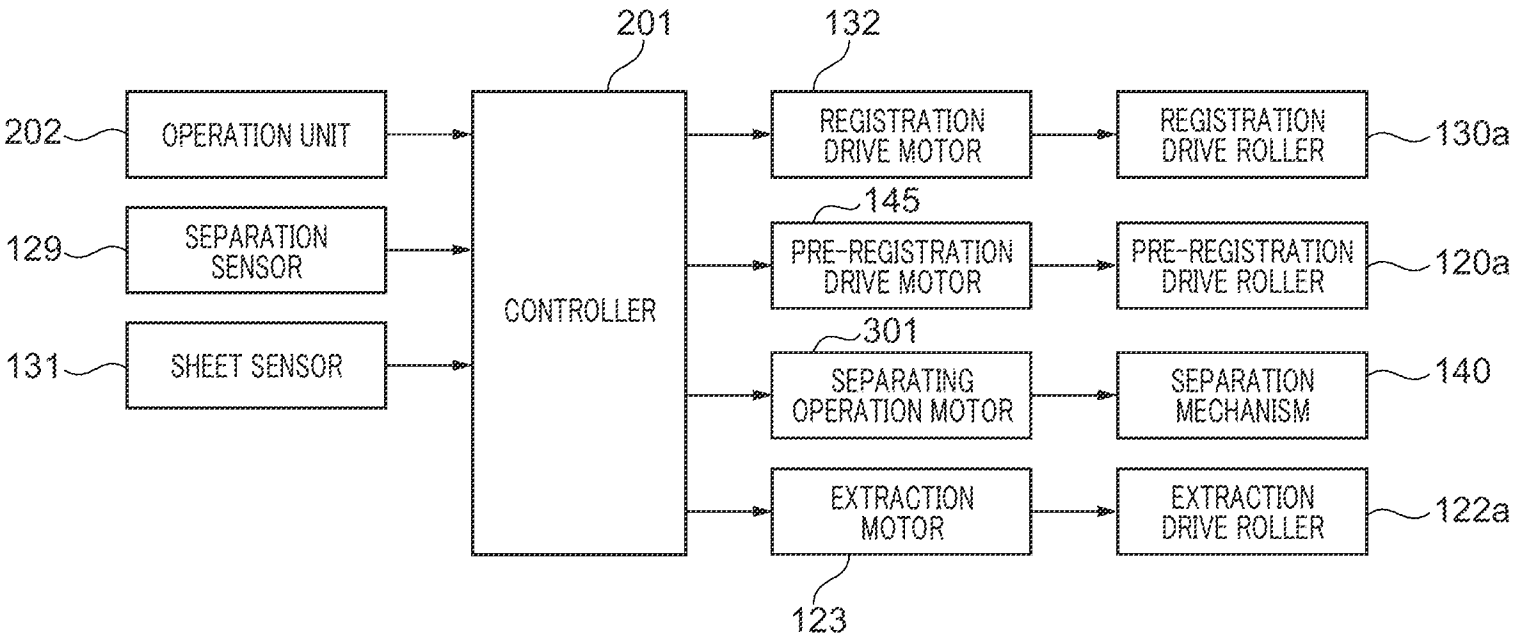
FIG. 12 is a block diagram showing a control configuration of the image forming apparatus according to the second embodiment.

Next, a sheet conveyance mechanism of the image forming apparatus 100 according to a second embodiment will be described by referring to FIG. 11 through FIG. 13. FIG. 11 is a perspective view showing the drive mechanism of the pre-registration rollers 120 according to this embodiment. FIG. 12 is a block diagram showing the control configuration of the image forming apparatus 100 according to this embodiment. FIG. 13 is a flowchart showing a control method for the image forming apparatus 100 according to this embodiment. Hereinafter, the same reference numeral is given to a common member to the first embodiment, and its description is omitted.

As shown in FIG. 11 and FIG. 12, a separating operation motor 301 that operates the switching mechanism 140 is provided as a second motor in addition to the pre-registration drive motor 145 as a first motor that rotates the pre-registration rollers 120 in this embodiment. The pre-registration drive motor 145 rotates the drive shaft 120*c* of the pre-registration drive roller 120*a* through the pre-registration drive gear 147. The separating operation motor 301 operates the switching mechanism 140 by rotating a gear 302 that rotates together with the cam 149 of the switching mechanism 140 to move the rotation shaft 120*d* of the pre-registration driven roller 120*b* through the separation arm 142. The controller 201 independently controls a drive state of the pre-registration drive motor 145 and a drive state of the separating operation motor 301. The switching mechanism 140 of the pre-registration rollers 120 of the second embodiment is configured to be operated by the drive of the separating operation motor 301 as shown in FIG. 12.

The control method of the image forming apparatus 100 in this embodiment will be described along with the flowchart in FIG. 13. The control of this embodiment differs from the first embodiment in the timing of operating the switching mechanism 140. The same reference numeral is given to a part that performs the approximately same process as the control of the first embodiment, and its description is omitted.

When a print job is started (F102), a sheet is fed from the cassette or the tray as the feed source (F109), and the pre-registration rollers 120 are controlled to be brought into the contact state (F201, F202). That is, the pre-registration rollers 120 are brought into the contact state while correcting the skew of the sheet in this embodiment. After the skew correction, the pre-registration rollers 120 are controlled to be brought into the separated state (F103 through F108) if needed.

Specifically, when the separation sensor 129 is not OFF at the time of the feed start of the sheet (F109), the pre-registration rollers 120 are brought into the contact state by rotating the separating operation motor 301 (F201, F202). After that, when the front end of the sheet is abutted to the stopped registration rollers 130 and the loop of the predetermined size is formed in the sheet (F110), the registration rollers 130 start rotating (F111).

Moreover, the determinations about the sheet feed source (F103), the sheet length (F104), and the basis weight (F105) are performed in order to determine whether to separate the pre-registration rollers 120 after the skew correction. Criteria of F103 through F105 can be identical to that of the first embodiment. When it is determined that the pre-registration rollers 120 will be separated, the pre-registration rollers 120 are separated (F108, F203) by rotating the separating operation motor 301. Otherwise, the process proceeds to F112 while keeping the contact state of the pre-registration rollers 120.

Moreover, the state of the pre-registration rollers 120 (F112), the sheet feed source (F113), and the sheet length (F114) are determined in order to determine the sheet conveyance speed V2 after the skew correction of the pre-registration rollers 120 and extraction rollers 122. Criteria of F112 through F114 can be identical to that of the first embodiment. The pre-registration rollers 120 and the extraction rollers 122 start rotating at the determined sheet conveyance speed V2 (F115, F116). The contents of the following process are the same as that of the first embodiment.

In this embodiment, the situation of whether to separate the pre-registration rollers 120 during the conveyance operation after the skew correction and the size relation between the sheet conveyance speed V1 of the registration rollers 130 and the conveyance speed V2 of the upstream roller pairs are determined on the basis of the conditions, such as the attribute of the sheet and the sheet feed source. Accordingly, since the suitable conveyance operation is executed corresponding to the conditions as with the first embodiment, occurrence of creases can be reduced while maintaining a conveyance property and a skew correction capability.

Moreover, since the device of this embodiment has the separating operation motor 301 in addition to the pre-registration drive motor 145, when the pre-registration rollers 120 are separated during the conveyance operation after the skew correction, degradation of productivity is avoided even if the pre-registration rollers 120 are in the contact state at the time of the skew correction. When the pre-registration rollers 120 and the switching mechanism 140 are driven by the single pre-registration drive motor 145 as described in the first embodiment, it is necessary to reverse the rotational direction of the motor before and after the separating operation of the pre-registration rollers 120. Specifically, the pre-registration drive motor 145 is rotated in the CW direction in F110 in FIG. 13, is rotated in the CCW direction in F202, and is rotated in the CW direction in F115 and F116. Then, the waiting time for stopping rotation of the pre-registration drive motor 145 and for starting the rotation in the reverse direction lengthens requisite time from feed start of the sheet to the ejection to the outside of the image forming apparatus. As compared with this, since it is not necessary to reverse the pre-registration drive motor 145 in this embodiment, sheet conveyance delay due to the separating operation of the pre-registration rollers 120 can be minimized.

In the flowchart shown in FIG. 13, the separating operation (F108, F203) of the pre-registration rollers 120 is performed after starting the rotations (F111) of the registration rollers 130 and before starting the rotations (F115, F116) of the pre-registration rollers 120 and extraction rollers 122. However, the separating operation of the pre-registration rollers 120 may be performed at another timing. For example, the determination of whether to perform the separating operation and the separating operation (F103 through F108, F203) may be performed after forming the loop of the predetermined size (F110) and before starting the rotations (F111) of the registration rollers 130. In that case, the rotations of the pre-registration rollers 120 and the extraction rollers 122 can be started simultaneously with the rotation start (F111) of the registration rollers 130. Moreover, since the device of this embodiment has the separating operation motor 301 in addition to the pre-registration drive motor 145, the rotational drive of the pre-registration rollers 120 and extraction rollers 122 may be performed simultaneously with the separating operation of the pre-registration rollers 120.

Although the above-mentioned embodiments describe the sheet conveyance device that conveys a sheet inside the image forming apparatus, the technique of the disclosure may be applied to another sheet conveyance device. For example, the technique of the disclosure may be applied to a device that conveys a sheet while correcting skew of the sheet in a sheet processing apparatus that applies a process, such as punch, to a sheet ejected from an apparatus body of an image forming apparatus. Moreover, the image forming device 150 (FIG. 1) of the intermediate transfer tandem system is an example of the image forming unit. The technique of the disclosure may be applied to a sheet conveyance device in an image forming apparatus of an ink jet system.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)'), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-194811, filed Nov. 25, 2020, which is hereby incorporated by reference herein in its entirety.

What is claimed is:

1. A sheet conveyance device comprising:

a pair of first conveyance rollers that nip and convey a sheet;

a pair of second conveyance rollers that are arranged downstream of the first conveyance rollers in a sheet conveyance direction and that nip and convey the sheet;

a pair of registration rollers that are arranged downstream of the second conveyance rollers in the sheet conveyance direction and that nip and convey the sheet after correcting skew of the sheet by abutting a leading end of the sheet to the registration rollers;

a switching portion that switches a state of the second conveyance rollers between a contact state where the second conveyance rollers are in contact and a separated state where the second conveyance rollers are separated; and a control unit configured to control the first conveyance rollers, the second conveyance rollers, the registration rollers, and the switching portion, wherein the control unit switches a conveyance operation between a first conveyance operation and a second conveyance operation and executes the first conveyance operation or the second conveyance operation, wherein in the first conveyance operation, the registration rollers start rotating to convey the sheet of which the skew has been corrected by the first conveyance rollers and the registration rollers, the second conveyance rollers are in the separated state, and a sheet conveyance speed by the registration rollers is higher than a sheet conveyance speed by the first conveyance rollers, and wherein in the second conveyance operation, the registration rollers start rotating to convey the sheet of which the skew has been corrected by the first conveyance rollers and the registration rollers, the second conveyance rollers are in the separated state, and the sheet conveyance speed by the registration rollers is lower than the sheet conveyance speed by the first conveyance rollers.

2. The sheet conveyance device according to claim 1, wherein the control unit switches the conveyance operation between the first conveyance operation and the second conveyance operation on a basis of a length of the sheet in the sheet conveyance direction and executes the first conveyance operation or the second conveyance operation, wherein the control unit executes the first conveyance operation in a case of conveying a sheet of which a length in the sheet conveyance direction is a first length, and wherein the control unit executes the second conveyance operation in a case of conveying a sheet of which a length in the sheet conveyance direction is a second length that is shorter than the first length.

3. The sheet conveyance device according to claim 1, further comprising:

a cassette that can be drawn from a device body and stores sheets; and a tray that is projected to outside of the device body and on which a sheet is placed, wherein the control unit executes the first conveyance operation in a case of conveying a sheet fed from the tray and executes the second conveyance operation in a case of conveying a sheet fed from the cassette.

4. The sheet conveyance device according to claim 1, wherein the control unit switches the conveyance operation among the first conveyance operation, the second conveyance operation, and a third conveyance operation, and wherein in the third conveyance operation, the registration rollers start rotating to convey the sheet of which the skew has been corrected by the second conveyance rollers and the registration rollers, the second conveyance rollers are in the contact state, and the sheet conveyance speed by the registration rollers is lower than a sheet conveyance speed by the second conveyance rollers.

5. The sheet conveyance device according to claim 4, wherein the control unit executes one of the first conveyance operation and the second conveyance operation in the separated state of the second conveyance rollers in a case of conveying a sheet having a first grammage and a first length in the sheet conveyance direction, and wherein the control unit executes the third conveyance operation in the contact state of the second conveyance rollers in a case of conveying a sheet having a second grammage that is greater than the first grammage and a case of conveying a sheet of which a length in the sheet conveyance direction is a second length that is shorter than the first length.

6. The sheet conveyance device according to claim 4, wherein the control unit sets the sheet conveyance speed of the first conveyance rollers and the second conveyance rollers in the third conveyance operation to be higher than the sheet conveyance speed of the registration rollers in the third conveyance operation.

7. The sheet conveyance device according to claim 4, further comprising:

a cassette that stores sheets; and a feed unit that feeds a sheet toward the second conveyance rollers from the cassette, wherein there is no pair of rollers other than the second conveyance rollers in the conveyance path from the feed unit to the registration rollers, and wherein the control unit controls the second conveyance rollers and the registration rollers to convey the sheet in the contact state of the second conveyance rollers in a case of feeding the sheet from the cassette.

8. The sheet conveyance device according to claim 1, further comprising a motor that is connected to the second conveyance rollers and the switching portion, wherein the second conveyance rollers are driven in a case where the motor rotates in a first direction, and wherein the switching portion is driven in a case where the motor rotates in a second direction opposite to the first direction.

9. The sheet conveyance device according to claim 1, further comprising:

a first motor that drives the second conveyance rollers; and a second motor that drives the switching portion, wherein the control unit controls the switching portion so that the second conveyance rollers will be in the contact state until correcting the skew of the sheet by the registration rollers, and wherein the control unit controls the switching mechanism so that the second conveyance rollers will be in the separated state after correcting the skew of the sheet.

10. An image forming apparatus comprising:

a sheet conveyance device comprising:

a pair of first conveyance rollers that nip and convey a sheet;

a pair of second conveyance rollers that are arranged downstream of the first conveyance rollers in a sheet conveyance direction and that nip and convey the sheet;

a pair of registration rollers that are arranged downstream of the second conveyance rollers in the sheet conveyance direction and that nip and convey the sheet after correcting skew of the sheet by abutting a leading end of the sheet to the registration rollers;

a switching portion that switches a state of the second conveyance rollers between a contact state where the second conveyance rollers are in contact and a separated state where the second conveyance rollers are separated; and a control unit configured to control the first conveyance rollers, the second conveyance rollers, the registration rollers, and the switching portion; and an image forming unit configured to form an image on the sheet fed from the registration rollers, wherein the control unit switches a conveyance operation between a first conveyance operation and a second conveyance operation and executes the first conveyance operation or the second conveyance operation, wherein in the first conveyance operation, the registration rollers start rotating to convey the sheet of which the skew has been corrected by the first conveyance rollers and the registration rollers, the second conveyance rollers are in the separated state, and a sheet conveyance speed by the registration rollers is higher than a sheet conveyance speed by the first conveyance rollers, and wherein in the second conveyance operation, the registration rollers start rotating to convey the sheet of which the skew has been corrected by the first conveyance rollers and the registration rollers, the second conveyance rollers are in the separated state, and the sheet conveyance speed by the registration rollers is lower than the sheet conveyance speed by the first conveyance rollers.

* * * * *